US011772120B2

(12) United States Patent
Gaylo

(10) Patent No.: US 11,772,120 B2
(45) Date of Patent: Oct. 3, 2023

(54) ADHESIVE RIBBON MIX HEAD WITH ATTACHMENT FOR MIX APPLICATOR

(71) Applicants: Compagnie Generale des Etablissements Michelin, Clermont-Ferrand (FR); Ryan Michael Gaylo, Canton, GA (US)

(72) Inventor: Ryan Michael Gaylo, Canton, GA (US)

(73) Assignee: Compagnie Generale des Etablissements Michelin, Clermont-Ferrand (FR)

( * ) Notice: Subject to any disclaimer, the term of this patent is extended or adjusted under 35 U.S.C. 154(b) by 0 days.

(21) Appl. No.: 17/772,181

(22) PCT Filed: Nov. 26, 2019

(86) PCT No.: PCT/US2019/063199
§ 371 (c)(1),
(2) Date: Apr. 27, 2022

(87) PCT Pub. No.: WO2021/107924
PCT Pub. Date: Jun. 3, 2021

(65) Prior Publication Data
US 2022/0395854 A1 Dec. 15, 2022

(51) Int. Cl.
*B05C 17/005* (2006.01)

(52) U.S. Cl.
CPC .. *B05C 17/00553* (2013.01); *B05C 17/00506* (2013.01); *B05C 17/00516* (2013.01); *B05C 17/00569* (2013.01); *B05C 17/00503* (2013.01)

(58) Field of Classification Search
CPC ..... B05C 17/00553; B05C 17/00506; B05C 17/00516; B05C 17/00503; B05C 17/005
(Continued)

(56) References Cited

U.S. PATENT DOCUMENTS 3,953,006 A * 4/1976 Patarcity ..... B29C 48/2888 366/100
5,413,253 A 5/1995 Simmen
(Continued)

FOREIGN PATENT DOCUMENTS

EP 0319639 A1 6/1989

OTHER PUBLICATIONS

European Patent Office, International Search Report dated Aug. 27, 2020, pp. 1-11 (included), European Patent Office, Rijswijk, The Netherlands.

*Primary Examiner* — David J Walczak
(74) *Attorney, Agent, or Firm* — Neal P. Pierotti

(57) ABSTRACT

An apparatus (10) for use in dispensing adhesive (18) is provided that has a mix applicator (12) that has a receiving portion (16) and a mix applicator bore (14) through which adhesive can flow. A mix head (20) is present that has a mix head bore (26) that extends through the mix head. The mix applicator is receivable within the mix head such that the receiving portion is located within the mix head. Adhesive can be dispensed in a ribbon shape from the mix head bore at a distal tip of the mix head. A lock member is configured for extending through at least a portion of the mix head, and engages the mix applicator when the receiving portion is located within the mix head in order to retain the mix head onto the mix applicator.

14 Claims, 8 Drawing Sheets

(58) Field of Classification Search
USPC ..... 222/566, 567, 570
See application file for complete search history.

(56) References Cited

U.S. PATENT DOCUMENTS

| | | | | |
|---|---|---|---|---|
| 5,575,409 | A | 11/1996 | Gruendeman | |
| 2002/0076260 | A1 | 6/2002 | Heusser | |
| 2014/0124536 | A1* | 5/2014 | Pappalardo | B05C 17/00553 222/137 |
| 2019/0022694 | A1 | 1/2019 | Dean et al. | |

* cited by examiner

ADHESIVE RIBBON MIX HEAD WITH ATTACHMENT FOR MIX APPLICATOR

CROSS-REFERENCE TO RELATED APPLICATIONS

The present application is a 35 U.S.C. § 371 application of PCT/US2019/063199 filed on Nov. 26, 2019 and entitled "Adhesive Ribbon Mix Head with Attachment for Mix Applicator." PCT/US2019/063199 is incorporated by reference herein in its entirety for all purposes.

FIELD OF THE INVENTION

The subject matter of the present invention relates to a mix head for dispensing a ribbon of adhesive that is attachable to a mix applicator. More particularly, the present application involves a ribbon mix head that has a lock member that is slid into and out of the mix head so as to be capable of engagement with a receiving portion of the mix applicator to effect attachment and detachment of the mix head and mix applicator.

BACKGROUND OF THE INVENTION

Non-pneumatic tires are those that do not require air or other fluid for their inflation for use. Some non-pneumatic tires have a plurality of spokes arranged circumferentially around and attached to a hub. On their opposite end, the spokes are attached to a shear band. In some non-pneumatic tires the spokes may be 64 in number and can be attached with adhesive to the shear band and hub. The adhesive used could be made in two parts and mixed together to form a final mixed adhesive that is transferred into a mix applicator. The mixed adhesive can be dispensed out of a mix tip at the end of the mix applicator and onto the shear band or the hub. However, the application of the adhesive in this manner results in a bead of adhesive being applied across the surface of the shear band and hub. When the spokes are engaged therewith, more adhesive will be present in the center of the connection between the spokes and the shear band and hub, and less at the edges of engagement of the spokes and shear band and hub. This results in inconsistent adhesive application and inconsistent attachment between the spokes and the other components of the non-pneumatic tire. Additionally, the placement of more adhesive in the center of the spoke ends results in the adhesive sliding/moving to the spoke free edges from the point of application during the curing process, which further results in an inconsistent chemical bond between the adhesive and two adjoining surfaces.

In order to better spread the adhesive onto the surfaces of the shear band and hub, a fan tip at the end of the mix applicator may be employed. Such a fan tip has a wide outlet for the adhesive to be dispensed in a wider pattern, referred to as a ribbon, instead of in a bead shape. However, such fan tips cause more adhesive to be put into the middle of the ribbon instead of at the edges of the wider pattern, again resulting in the aforementioned problems with more adhesive in the center of the desired area of engagement. Also, such fan tips can engage the surfaces of the shear bands and hubs thus causing the adhesive dispensed thereon to smear and exhibit inconsistencies in the resulting spoke attachment. Further, there are no current fan tips that can be attached to current mix applicators for the dispensing of adhesive in conjunction with the manufacturing or repair of non-pneumatic tires. Such fan tips are assembled using force fit engagements or threaded engagements in which the fan tip may end up rotated in relation to the mix applicator once attached making it unable to dispense adhesive as desired. As such, there remains room for variation and improvement within the art.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

The use of identical or similar reference numerals in different figures denotes identical or similar features.

DETAILED DESCRIPTION OF THE INVENTION

Figure 1:
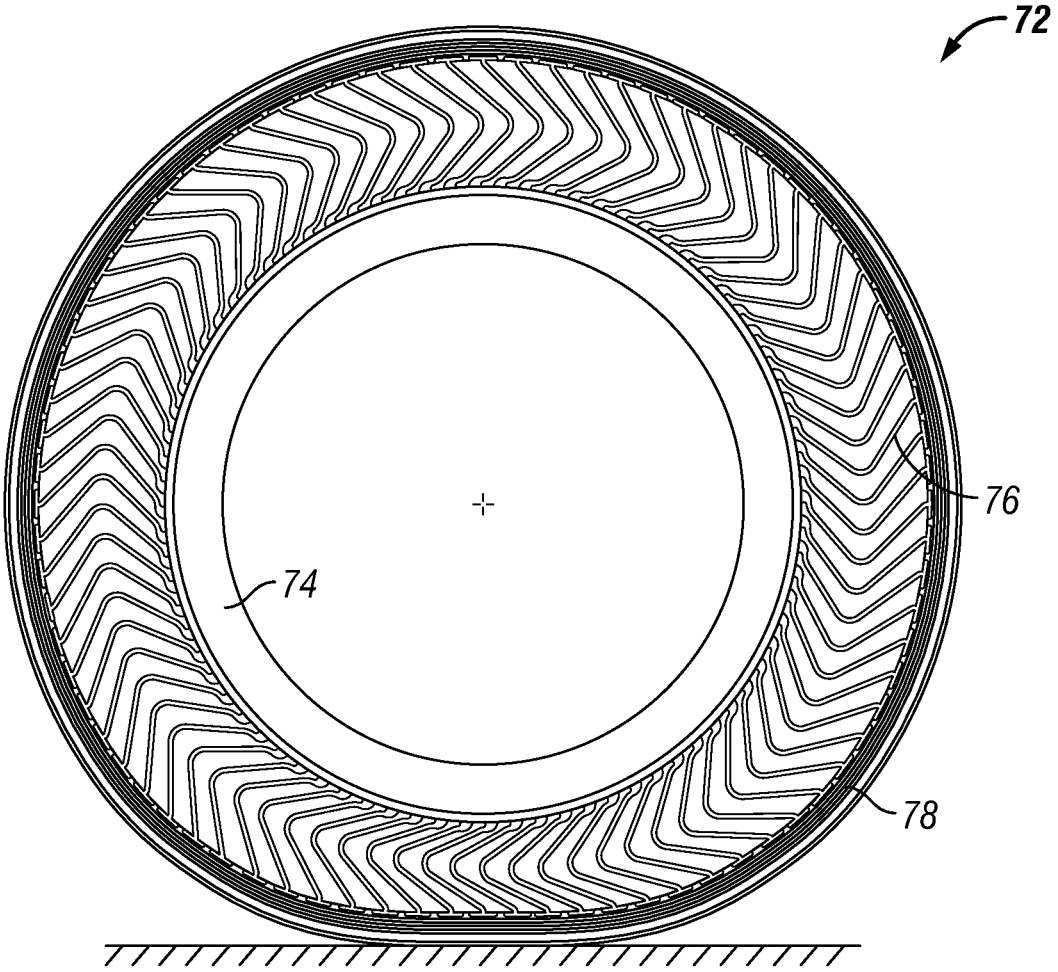
FIG. 1 is a side view of a non-pneumatic tire.

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

The present invention provides for an apparatus 10 for dispensing a ribbon of adhesive 18 that can be used in the construction of a non-pneumatic tire 72. The apparatus 10 includes a mix applicator 12 through which the adhesive 18 may be transferred from, for example, an adhesive pump 70. A mix head 20 is located at the distal end of the mix applicator 12 and has a fan shaped distal tip 28 from which the adhesive 18 is dispensed. The exit 66 at the distal tip 28 is arranged in such a manner that the adhesive 18 that flows out is shaped in the form of a wide ribbon to allow for easier construction of the non-pneumatic tire 72. When connected, a receiving portion 16 of the mix applicator 12 is disposed within the mix head 20. The mix head 20 is retained to the mix applicator 12 by way of a lock member 30 that can be moved into and out of engagement with the mix applicator 12 to achieve selective retention.

FIG. 1 shows a non-pneumatic tire 72. The non-pneumatic tire 72 has a hub 74 with a central axis at its center, and the radial direction extends from this central axis. Tread is located on the outer exterior of a shear band 78 and extends all the way around the non-pneumatic tire 72 in the circumferential direction. The shear band 78 is located inward in the radial direction from the tread and likewise extends 360 degrees around the central axis in the circumferential direction. A series of spokes 76 engage the shear band 78 and extend inward in the radial direction from the shear band 78 to the hub 74 of the non-pneumatic tire 72. Any number of spokes 76 can be present, and their cross-sectional shape can be different from that shown. In some instances, between 64-80 spokes 76 are present in the non-pneumatic tire 72. The hub 74 is located inward from the spokes 76 in the radial direction and can be mounted onto a wheel of the vehicle. The spokes 76 at the top of the non-pneumatic tire 72 are in tension, and the spokes 76 at the bottom are in compression as the non-pneumatic tire 72 rests on the ground and as the non-pneumatic tire 72 turns in normal operation of the vehicle.

Figure 2:
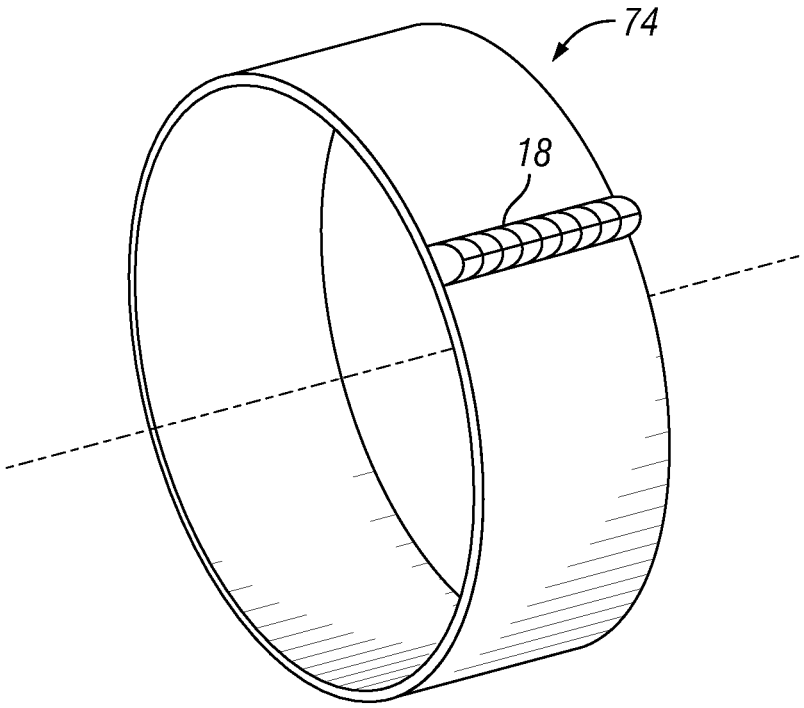
FIG. 2 is a perspective view of a hub with curved, bead shaped adhesive disposed onto its outer surface.

FIG. 2 shows a perspective view of a hub 74 of the non-pneumatic tire 72 before assembly. In order to attach the spokes 76 to the hub 74, a bead of adhesive 18 can be dispensed onto the outer surface of the hub 74 and then the spoke 76 could be placed onto this bead of adhesive 18 for securement. Additionally or alternatively, the bead of adhesive 18 could be placed onto the end of the spoke 76. The bead of adhesive 18 is dispensed from the tip of a mix applicator that has a circular cross-sectional shape and results in a large, curved portion of adhesive 18 that is thicker in the center of the spoke 76 connection than on the edges of the spoke 76 connection.

Figure 3:
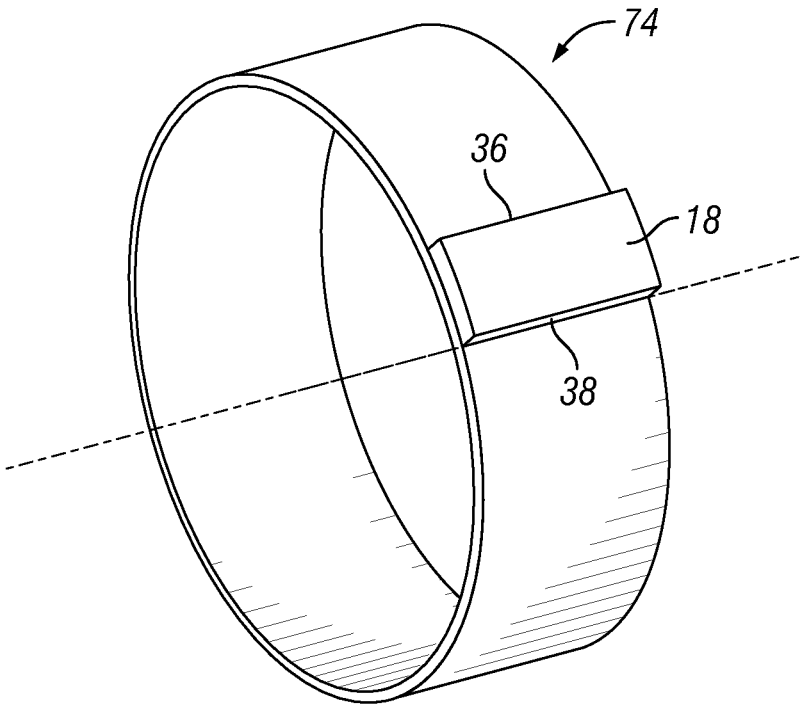
FIG. 3 is a perspective view of a hub with a ribbon of adhesive disposed on its outer surface.

FIG. 3 shows a hub 74 with a ribbon of adhesive 18 disposed onto its outer surface for again the attachment of a spoke 76. The ribbon of adhesive 18 could alternatively or additionally placed onto the end of the spoke 76 that is placed into engagement with and secured to the hub 74. The ribbon of adhesive 18 when dispensed is wider in form than the previously described bead of adhesive 18 such that the adhesive is more evenly spread along the width of the ribbon of adhesive 18. The ribbon of adhesive 18 is arranged so that material is spread towards opposite ends 36, 38 of the ribbon such that less accumulation of material exists at the center of the dispensing. The ribbon of adhesive 18 thus has a more even spread of adhesive 18 so that when the spoke 76 is located thereon adhesive 18 is more evenly positioned to all engaging surfaces of the spoke 76 to achieve a more robust connection. It is to be understood that the ribbon of adhesive 18 need not have perfectly distributed material throughout its entire length and width in all instances. The ribbon of adhesive 18 can be placed onto the outer surface of the hub 74 along the entire width of the outer surface in the axial direction of the non-pneumatic tire 72.

Although not shown, the apparatus 10 may also be used for the attachment of the spokes 76 to the shear band 78. In this regard, the ribbon of adhesive 18 could be placed onto the inner surface of the shear band 78 and/or the end of the spokes 76 that engage and are connected to the inner surface of the shear band 78. The apparatus 10 could thus be used to dispense a ribbon of adhesive 18 for purposes of connecting spokes 76 to the shear band 78 and/or the hub 74. The adhesive 18 could be any type of adhesive 18 capable of connecting these parts to one another. In some instances, the adhesive 18 is cushion gum.

Figure 4:
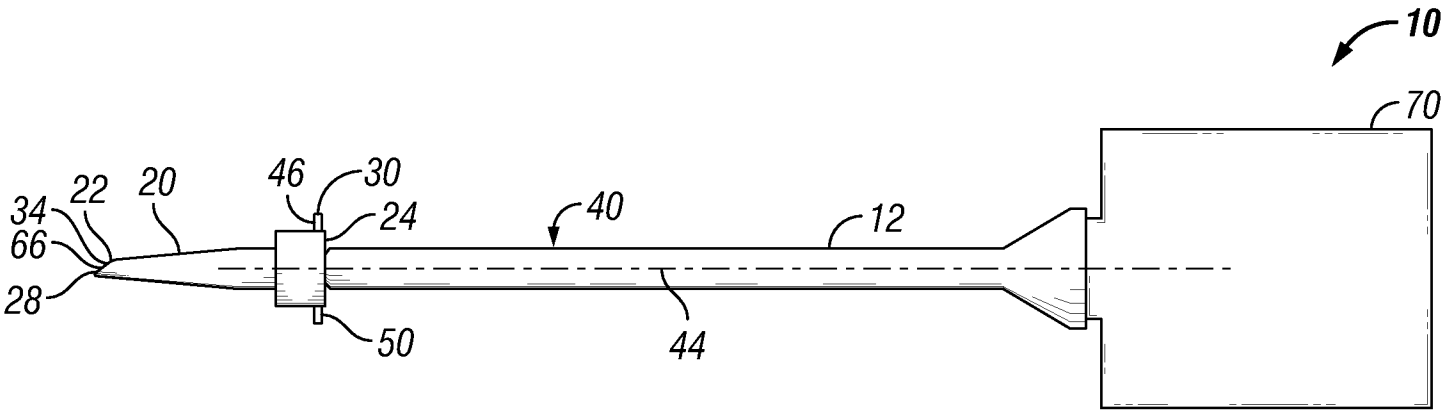
FIG. 4 is a side view of an apparatus in accordance with one exemplary embodiment.
Figure 5:
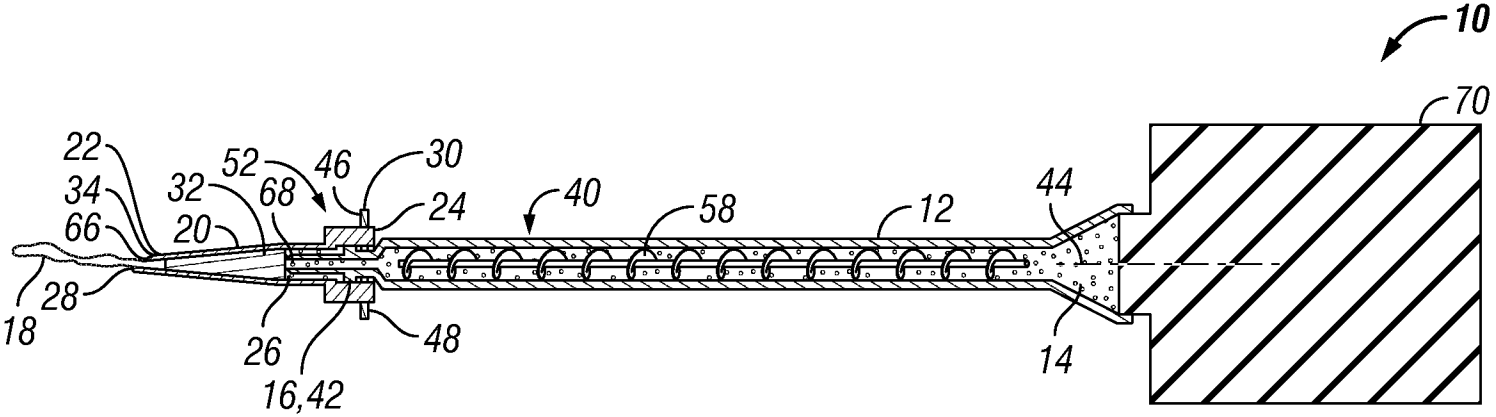
FIG. 5 is a side cross-sectional view of the apparatus of FIG. 4.

One exemplary embodiment of the apparatus 10 is shown with reference to FIGS. 4 and 5. The cross-sectional view in FIG. 5 is taken through the middle of FIG. 4. The apparatus 10 may have an adhesive pump 70 that includes adhesive 18 and dispenses this adhesive 18 under pressure to the mix applicator 12. Any variety of device may be used to transfer the adhesive 18 to the mix applicator 12. The mix applicator 12 has a proximal end that is attached to an outlet of the adhesive pump 70, and this attachment could be effected via a friction fit attachment, or a pin (not shown) can be inserted through the proximal end of the mix applicator 12 and into the attachment port of the adhesive pump 70 to both attach the mix applicator 12 to the adhesive pump 70, and to provide a known orientation to the mix applicator 12. The mix head 20 is attached to the distal end of the mix applicator 12 via a lock member 30. The adhesive 18 is dispensed from the adhesive pump 70 and into the mix applicator 12 where it is transferred into the mix head 20 and then subsequently dispensed from the mix head 20 onto the hub 74, spoke 76, and/or shear band 78 in a ribbon shape.

Figure 6:
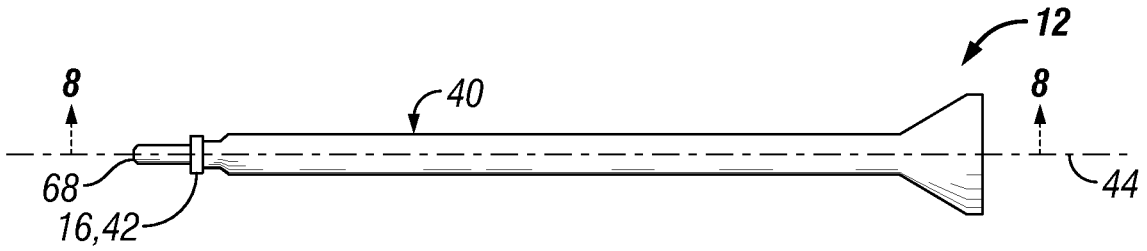
FIG. 6 is a side view of a mix applicator in accordance with one exemplary embodiment.
Figure 7:
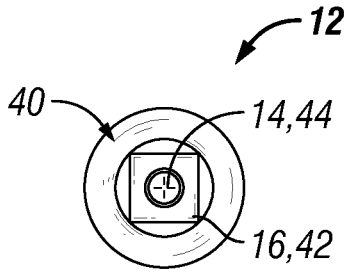
FIG. 7 is a front view of the mix applicator of FIG. 6.
Figure 8:
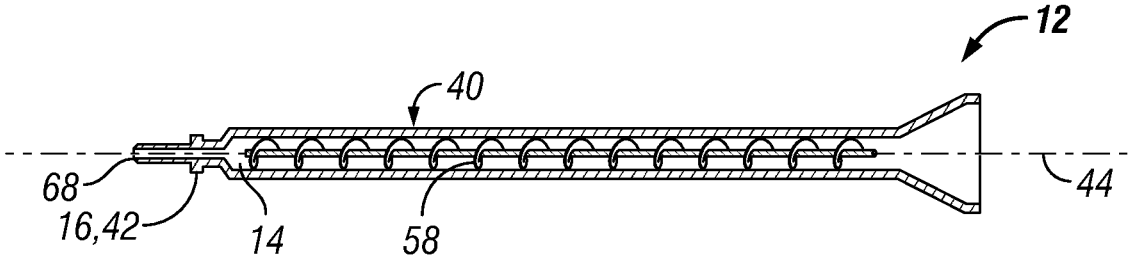
FIG. 8 is a side cross-sectional view of the mix applicator of FIG. 6.
Figure 9:
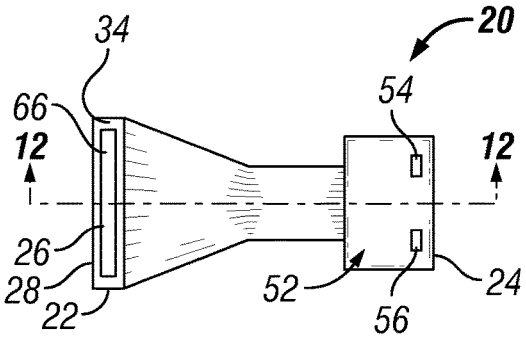
FIG. 9 is a top view of a mix head in accordance with one exemplary embodiment.
Figure 10:
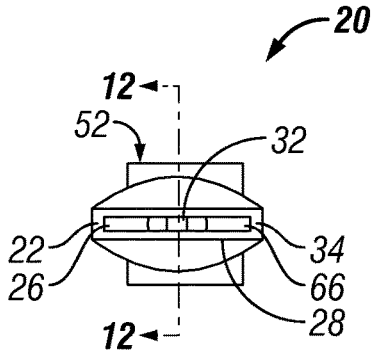
FIG. 10 is a front view of the mix head of FIG. 9.
Figure 12:
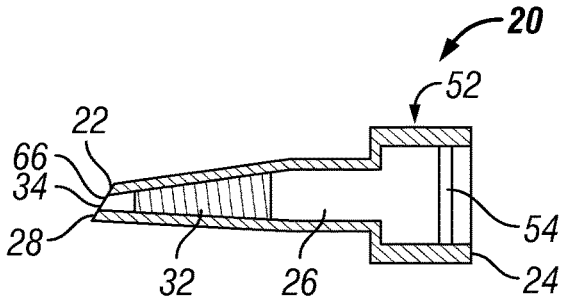
FIG. 12 is a cross-sectional view taken along line 12-12 of FIGS. 9-11.
Figure 11:
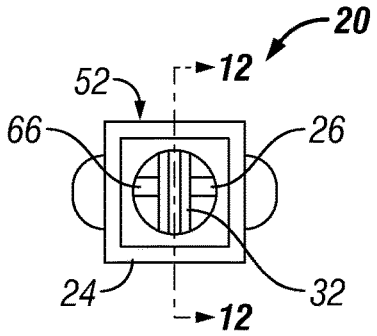
FIG. 11 is a back view of the mix head of FIG. 9.

The mix applicator 12 component of the apparatus 10 may be described in more detail with reference to FIGS. 6-8. The mix applicator 12 has a mix applicator central axis 44 that extends through the length of the mix applicator 12. The mix applicator 12 can be symmetrical about the mix applicator central axis 44. The mix applicator 12 can have a square or circular cross-sectional shape. However, if an opening or pin is present for connection to the adhesive pump 70, then this symmetry may not exist. Still further, certain embodiments exist in which the receiving portion 16 is not symmetrical about the mix applicator central axis 44. A mix applicator bore 14 extends completely through the mix applicator 12 so that adhesive 18 can be transferred completely through the mix applicator 12. The mix applicator bore 14 does not have the same diameter at all points along the length of the mix applicator 12. The mix applicator bore 14 can be circular in cross-sectional shape at all points along its length, or may have different shapes at different locations. A helical member 58 could be located within the mix applicator bore 14 and may be disposed along a majority of, but not the entirety of, the length of the mix applicator bore 14. Adhesive 18 that is transferred into and flowing through the mix applicator bore 14 engages the helical member 58 which functions to mix the adhesive 18 as it is transferred under pressure. The helical member 58 could therefore impart additional mixing to the adhesive 18 so that it dispensed in a desired state. This may be useful when the adhesive 18 is made of two or more parts that need to be mixed with one another. The helical member 58 is stationary with respect to the other portions of the mix applicator 12, and has a central shaft with a number of helical turns on the central shaft. The adhesive 18 is capable of moving past these helical turns and the central shaft through the mix applicator bore 14. However, engagement with the helical turns and central shaft causes a mixing of the adhesive 18 as it is transferred through the mix applicator bore 14. It is to be understood that the helical member 58 is optional and is not present in certain versions of the apparatus 10.

The mix applicator bore 14 narrows as it extends distal to the helical member 58. In a similar manner, the exterior surface 40 extends closer to the mix applicator central axis 44 at this point upon extending distal to the helical member 58. A receiving portion 16 is defined on the exterior surface 40. As illustrated, the receiving portion 16 is a projection 42 that extends from the exterior surface 40 and has a square cross-sectional shape. In other embodiments, the projection 42 need not extend 360 degrees about the mix applicator central axis 44. In such embodiments, the projection 42 extends from just one side of the exterior surface 40 and can extend 180 degrees or less about the mix applicator central axis 44, or can extend 90 degrees or less about the mix applicator central axis 44. The projection 42 is arranged so that it extends farther from the mix applicator central axis 44 than the portion of the exterior surface 40 immediately proximal to the projection 42. Also just proximal to the projection 42, the exterior surface 40 is narrower and then extends outward in the radial direction so as to be farther from the mix applicator central axis 44. Distal to the projection 42 the exterior surface 40 may maintain the same diameter or may at certain points change diameter up to the exit 68 of the mix applicator bore 14. The exit 68 at the distal terminal end of the mix applicator 12 has a circular cross-sectional shape and is smaller in diameter than a majority of the rest of the mix applicator bore 14. The adhesive 18 is dispensed from the mix applicator 12 from the exit 68.

FIGS. 9-12 show in greater detail the mix head 20 that is incorporated into the apparatus 10 of FIGS. 4 and 5. A mix head bore 26 extends completely through the mix head 20 to allow the adhesive 18 to be transferred completely through and out of the mix head 20. The mix head bore 26 at a proximal end 24 of the mix head 20 is square in cross-sectional shape and is the largest segment of the mix head bore 26 with respect to cross-sectional area. The mix head 20 has an exterior surface 52, and the exterior surface 52 at the proximal end 24 may likewise be square shaped. A pair of holes 54, 56 extend through the exterior surface 52 and into the mix head bore 26. The holes 54, 56 may continue through the lower portion of the mix head 20 so that they exit through the bottom of the exterior surface 52 so that the holes 54, 56 are through holes. In other embodiments, the holes 54, 56 may terminate at the mix head bore 14 so that they do not extend through the bottom portion of the mix head 20. The holes 54, 56 could be disposed through a portion of the sidewalls of the mix head 20 defining the mix head bore 26 at the proximal end 24 so that the holes 54, 56 have a different cross-sectional shape depending upon whether the holes 54, 56 are within the mix head bore 26 or not.

Immediately distal to the square shaped section, the mix head 20 features a circular shaped exterior surface 52 with a corresponding circular cross-sectional shaped mix head bore 26. The mix head bore 26 thus transitions from a square cross-sectional shape to a circular cross-sectional shape at this location. From this circular shaped section, the exterior surface 52 and the mix head bore 26 assume a fan shape that helps the adhesive 18 achieve its dispensed ribbon shape. The exterior surface 52 and the mix head bore 26 increase in size in the width direction upon extension in the distal direction from this circular shaped portion. However, at the same time the height of the exterior surface 52 and the mix head bore 26 decreases upon extension in the distal direction from this circular shaped portion. The trend of these surfaces 52 and bore 26 can continue until the mix head 20 terminates at the terminal distal end at a distal tip 28. The distal end 22 of the mix head 20 includes a chamfer 34 that is an angle at the distal end 22 that may more effectively dispense the adhesive 18 into a desired ribbon shape. The adhesive 18 is dispensed from an exit 66 of the mix head bore 26. The chamfer 34 may be arranged at any inclination angle, and need not be present in other embodiments. The chamfer 34 results in a distal tip 28 that could engage the hub 74, spoke 76, or shear band 78 onto which the adhesive 18 is dispensed when the adhesive 18 flows from the exit 66.

The mix head 20 within the mix head bore 26 includes a divider 32 that is centered within the mix head bore 26 such that the mix applicator central axis 44 extends through the divider 32 when the mix head 20 is retained onto the mix applicator 12. The divider 32 has two walls that divide and then merge back into one another upon extension within the mix head bore 26 in the longitudinal direction in the distal to proximal direction. When the adhesive 18 meets the divider 32, the adhesive 18 is channeled to the left and right sides within the mix head bore 26 and out of the middle of the mix head bore 26. The divider 32 is sized in the width direction so that it is not wider than the mix head bore 26 at the circular cross-sectional shaped section of the mix head bore 26. The divider 32 has a height that extends across the entire height of the mix head bore 26 so that none of the adhesive 18 flows under or over the divider 32, but can only flow to the left or right of the divider 32. The divider 32 thus blocks adhesive 18 from flowing through the middle of the mix head bore 26 along at least a portion of the length of the mix head bore 26. This blockage channels the adhesive 18 to the ends and away from the middle so that when the adhesive 18 is dispensed from the exit 66 it will be more evenly distributed about the width of the formed ribbon and not primarily in the middle of the dispensed form. The divider 32 may thus function to help the ribbon of adhesive 18 have a consistent volume along its entire dispensed width from end 36 to end 38. The divider 32 may thus prevent a thicker adhesive 18 layer in the middle of the ribbon as compared to the ends 36, 38. However, even when the divider 32 is present, and when it is not present, it may still be the case that more adhesive 18 is present at the middle of the ribbon than at the ends 36 or 38.

The divider 32 does not extend to the distal tip 28 and terminates at a location short of the exit 66. This termination short of exit 66 allows the adhesive 18 to merge back into itself in the middle from the edges so that the adhesive 18 is evenly spread in volume along its width. In other embodiments, the divider 32 may extend to the distal tip 28 and thus split the exit 66 into two pieces. The divider 32 is spaced from the circular cross-section portion of the mix head bore 26 in the longitudinal direction so that some portion of the fan shaped section of the mix head bore 26 exists without the divider 32 from the circular cross-section. It is to be understood that the divider 32 need not be present in other exemplary embodiments. Another function of the divider 32 is to provide support for the upper and lower walls of the mix head 20 to make the distal end 22 structurally stronger to support forceful engagement with the hub 74, spoke 76, shear band 78, or other item that may be engaged by the mix head 20.

Figure 14:
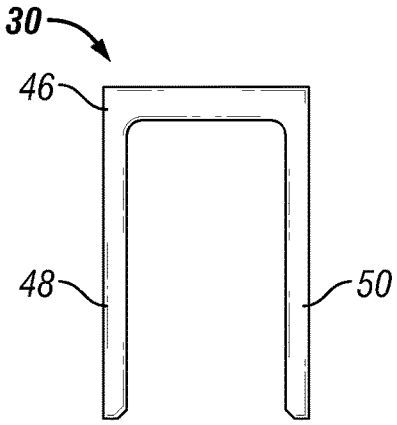
FIG. 14 is a front view of the lock member of FIG. 13.
Figure 15:
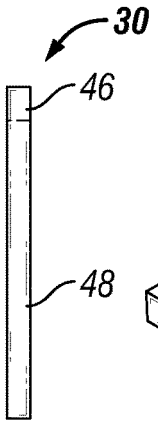
FIG. 15 is a side view of the lock member of FIG. 13.
Figure 13:
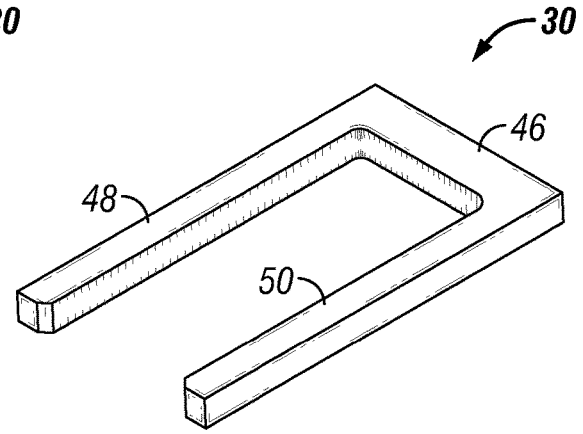
FIG. 13 is a perspective view of a lock member in accordance with one exemplary embodiment.

One exemplary embodiment of the lock member 30 is shown with reference to FIGS. 13-15. The lock member 30 has a base 46 from which a pair of tines 48, 50 extend so that a cavity is defined between these three members 46, 48, 50 which is open on one end in addition to being open at the top and bottom. Tines 48, 50 may be integrally formed with the base 46 so that all of these components make up a single integral piece. The tines 48, 50 may be each longer in length than the width of the base 46. Although shown with a pair of tines 48, 50 the lock member 30 could be variously constructed in accordance with other embodiments. For example, a single tine 48 with a handle could be present so that two or more tines 50 are not present. The lock member 30 could be a circular shaped member that fits the mix applicator 12 and mix head 20 to effect their attachment.

With reference back to FIGS. 4 and 5, the various components 70, 12, 20, 30 are assembled into their connected states to form the apparatus 10. The mix head 20 is fitted onto the distal end of the mix applicator 12 so that the receiving portion 16 is located within the mix head 20 and rests within the mix head bore 26. The square shape of the projection 42 is complimentary to the square shape cross-section of the mix head bore 26. The exit 68 of the mix applicator 12 is advanced as well into the mix head bore 26 and can be in the circular shaped cross-sectional portion of the mix head bore 26 stopping short of, or in some instances engaging, the divider 32. Depending upon the sizes, the receiving portion 16 could stop short of the circular shaped cross-sectional portion of the mix head 20 so that a space is between them. However, the receiving portion 16 could engage this circular shaped section in other embodiments when the mix head 20 and the mix applicator 12 are attached to one another. The projection 42 could engage the square shaped walls that define the square shaped portion of the mix head bore 26. The proximal end 24 may engage the exterior surface 40 at the widening portion that transitions to the section of the mix applicator 12 that houses the helical member 58 when the mix head 20 is attached to the mix applicator 12. Although square shaped cross-sections are preferred for the proximal end 24 and the complimentary shaped receiving portion 16, other shapes are possible such as round, oval, or rectangular.

The attachment between the mix applicator 12 and the mix head 20 may be effected by the lock member 30. The user may first fit the mix head 20 onto the mix applicator 12 so that the receiving portion 16 is within the mix head bore 26. The tine 48 can be inserted into the hole 54, and the tine 50 can be inserted into the hole 56. The lock member 30 may be advanced so that the base 46 engages the exterior surface 40 and the tines 48, 50 extend out of the mix head 20 at its bottom thus going all the way through the mix head 20. The lock member 30 is positioned so that the tines 48, 50 straddle the exterior surface 40 at a location between the receiving portion 16 and the enlarging section of the exterior surface 40 that enlarges to accommodate the helical member 58. The tines 48, 50 may engage the exterior surface 40 or could be spaced from it when they are located within the holes 54, 56. If the mix head 20 is moved relative to the mix applicator 12, the projection 42, receiving portion 16 may engage the tines 48, 50 to prevent further relative motion so that the mix head 20 is locked onto the mix applicator 12. The engagement of the lock member 30 within the mix head 20, and the fitting of the mix applicator 12 and the mix head 20 could be quite tight so that there is little to no relative movement between the components when the lock member 30 is inserted. Further, the fit between the mix head 20 when placing it onto the mix applicator 12 may be a slight press fit so that the mix head 20 must be forced somewhat onto the distal end of the mix applicator 12, and this tight connection may prevent backflow when adhesive 18 is dispensed.

When in the attached configuration, the lock member 30 extends through the mix head 20. The lock member 30 could extend completely through the mix head 20, or may extend through just a portion but not all of the mix head 20. The lock member 30 engages the mix applicator 12 at the receiving portion 16 to retain the components 12, 20 together. In some cases, the lock member 30 may engage the shaft of the mix applicator 12 as well when the components 12, 20 are attached.

The apparatus 10 could be disassembled if needed by removing the lock member 30 so that the tines 48, 50 are removed from the holes 54, 56 and the lock member 30 is disengaged from the mix head 20. The mix head 20 may then be pulled off of the end of the mix applicator 12 so that the receiving portion 16 is moved out of the mix head bore 26. The components could be cleaned, or a new different type of mix head 20 put onto the mix applicator 12 if a different sized adhesive 18 ribbon or different shaped adhesive 18 ribbon is desired to be dispensed.

Figure 16:
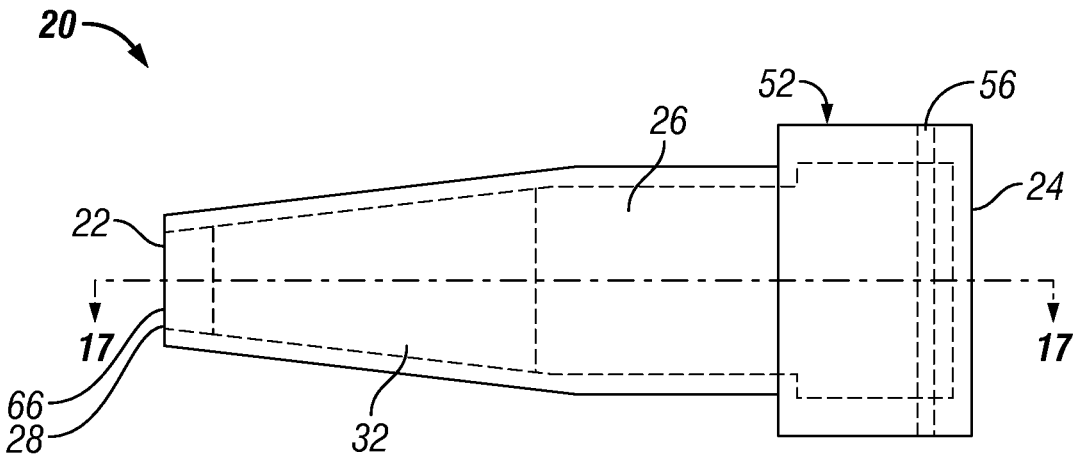
FIG. 16 is a side view of a mix head in accordance with another exemplary embodiment.
Figure 17:
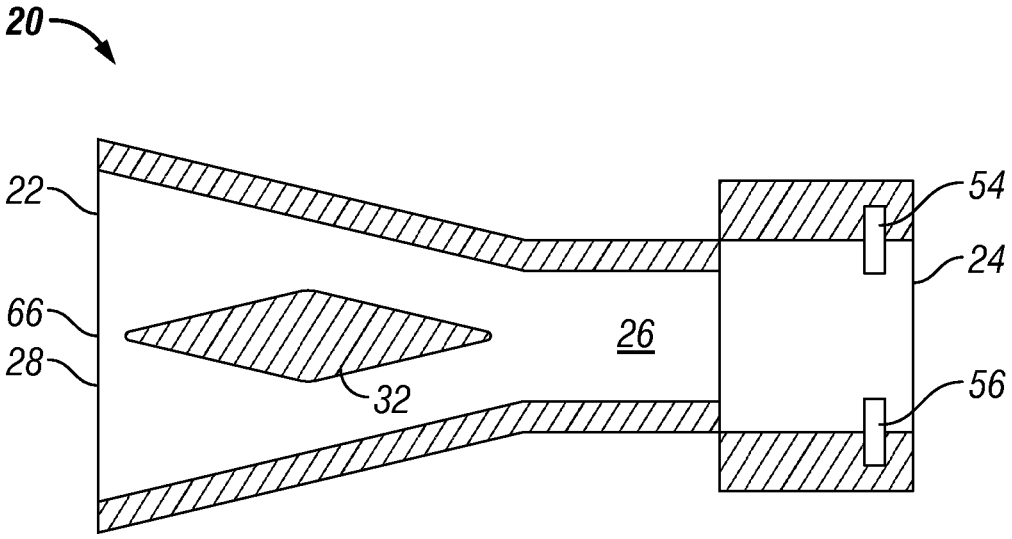
FIG. 17 is a cross-sectional view taken along line 17-17 of FIG. 16.

An alternative embodiment of the mix head 20 is shown in FIGS. 16 and 17. The divider 32 may be provided in the same manner as previous embodiments, and the cross-section view shows the divider 32 as having flat, inclined walls that diverge from one another and then converge back to one another in the proximal to distal direction through the mix head bore 26. The divider 32 is likewise spaced from the distal tip 28 some distance, and thus does not extend all the way to the exit 66. The mix head 20 in FIGS. 16 and 17 differ from previous embodiments in that the chamfer 34 at the distal end 22 is not present. Instead, the distal end 22 ends at a wall that is vertical in orientation so that a desired dispensing of the adhesive 18 is achieved. The holes 54, 56 again extend all the way through the entire height of the mix head 20. However, in other embodiments the holes 54, 56 could terminate short of the exterior surface 52 so as to terminate within the mix head 20 in other embodiments.

Figure 18:
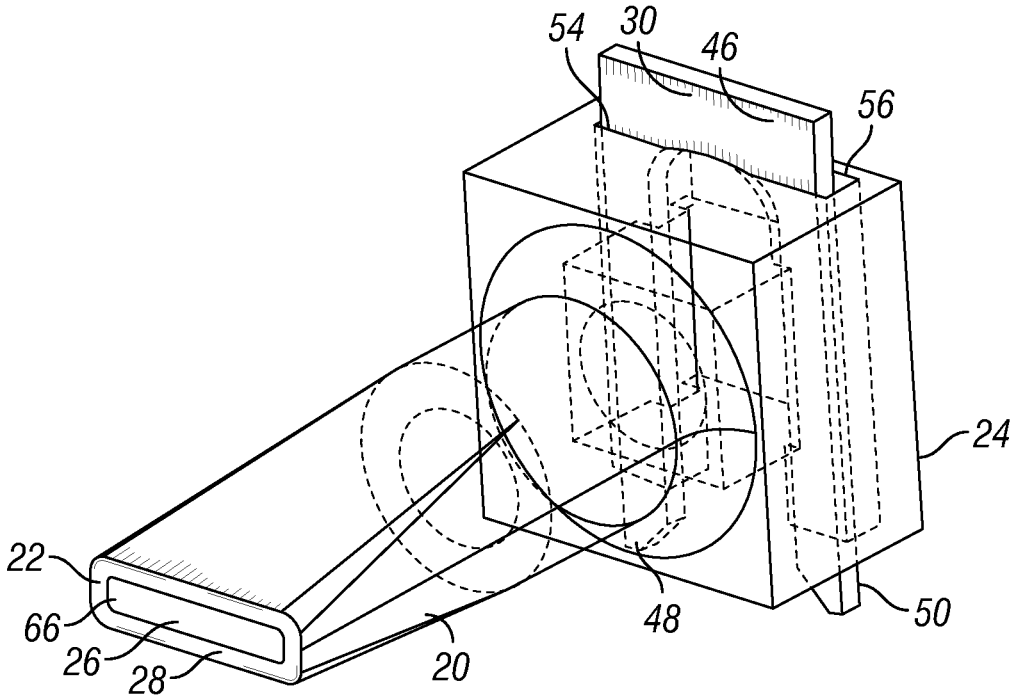
FIG. 18 is a perspective view of a mix head with attached lock member in accordance with another exemplary embodiment.

FIG. 18 is an alternative embodiment of the mix head 20 and is a perspective view of the mix head 20 with the lock member 30 engaged. However, the mix applicator 12 is not illustrated in FIG. 18. Internal features of the mix head 20 can be seen in dashed lines in FIG. 18. The exit 66 is more narrow than the other embodiments previously described. The exit 66 can be wider or more narrow depending upon the desired width from end 36 to end 38 that the user wants for the ribbon of adhesive 18. The mix head 20 does not have a divider 32, and a chamfer 34 is not present at the distal end 22 such that the distal tip 28 is a vertical wall with the exit 66 extending therethrough. The divider 32 and the chamfer 34 are optional features of the apparatus 10 and may or may not be present in various embodiments either both being present, or one of them 32, 34 being present. The lock member 30 is provided in the FIG. 18 embodiment in the same manner as previously discussed embodiments.

Figure 19:
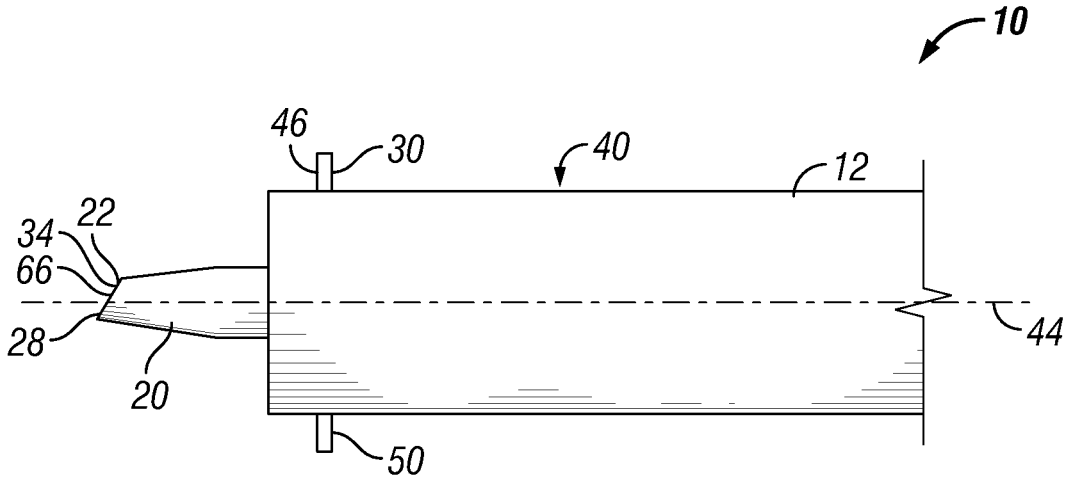
FIG. 19 is a side view of an apparatus in accordance with another exemplary embodiment.

An alternative embodiment of the apparatus 10 is shown in side view in FIG. 19. The mix head 20 and lock member 30 may be the same as in previous embodiments. However, the mix applicator 12 is somewhat different from the mix applicator 12 previously discussed. The mix applicator 12 could again be connected to an adhesive pump 70 (not shown) so that adhesive 18 is dispensed from the adhesive pump 70, then into the mix applicator 12, then into the mix head 20, and then out of the exit 66 for dispensing onto the hub 74, spoke 76, or shear band 78. The mix applicator 12 has an exterior surface 40 that is square shaped in height and width, and is elongated in the longitudinal, length direction. The mix head 20 is received within the distal end of the mix applicator 12, and the lock member 30 is used to attach the mix head 20 to the mix applicator 12 and prevent their detachment during use of the apparatus 10.

Figure 20:
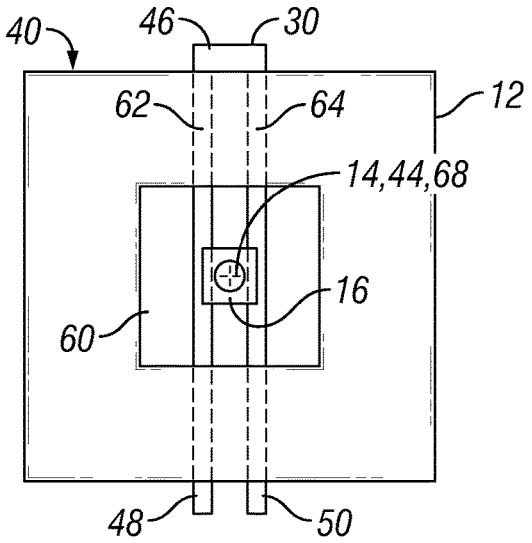
FIG. 20 is a front view of the mix applicator and attached lock member of the apparatus of FIG. 19.

FIG. 20 is a front view of the mix applicator 12 with the attached, engaged lock member 30. The mix applicator 12 can be a member into which adhesive 18 is mixed, or a member through which water, air, or other fluid is transferred and dispensed into the mix head 20. As such, it is to be understood that the mix applicator 12 need not be used exclusively for the mixing of substances but is broad enough to cover any member that engages and attached to the mix head 20 and through which a fluid may flow. In the FIG. 19-21 embodiments, the particular mix applicator 12 shown is a cleaning device through which fluid may be transferred into the mix head 20 for use in cleaning adhesive 18 out of the mix head 20. The mix head 20 is not shown in FIG. 20 for sake of clarity. It is to be understood that the mix head 20 would be present when the lock member 30 is engaged in the apparatus 10. The mix applicator 12 has a recess 60 on its distal end that extends into the interior of the mix applicator 12. The recess 60 is square shaped, and has the same cross-sectional shape as the exterior surface 40. The recess 60 extends some depth into the mix applicator 12 and then terminates at a wall. The receiving portion 16 extends from this wall in the longitudinal direction and fills up a portion of the recess 60. However, the receiving portion 16 does not extend all the way to the start of the recess 60 but instead terminates at some point short of the start of the recess from the exterior surface 40 and thus remains within the recess 60. The receiving portion 16 is square in cross-section, and the mix applicator central axis 44 extends through and is located within the receiving portion 16. Additionally, the mix applicator bore 14 is within the receiving portion 16, and the exit 68 is at the end of the receiving portion 16.

A pair of holes 62, 64 are through holes that extend through the entire height of the mix applicator 12. The holes 62, 64 extend into the mix applicator 12 from the exterior surface 40. The holes 62, 64 reach the recess 60, and a portion of the holes 62, 64 extend through the receiving portion 16 such that their cross-sectional shape changes at the receiving portion 16 to be that of an open slot instead of the rectangular shaped holes 62, 64 in the upper section of the mix applicator 12. The holes 62, 64 then exit the recess 60 and extend into and through the lower portion of the mix applicator 12 puncturing through the lower exterior surface 40. The lock member 30 is insertable within the holes 62, 64 so that the tine 48 is inserted within hole 62, and tine 50 is within hole 64. The base 46 may engage the exterior surface 40. The tines 48, 50 extend through the slot like formations the holes 62, 64 make in the receiving portion 16 and may engage the receiving portion 16. The tines 48, 50 extend out of the bottom of the mix applicator 12, but in other arrangements they may stop short of this extension.

Figure 21:
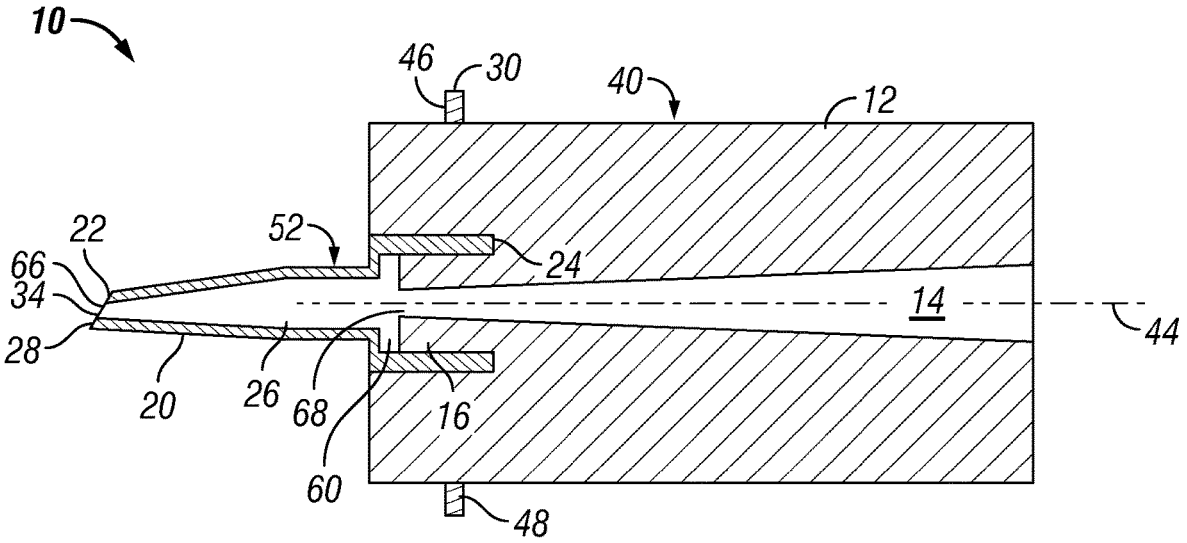
FIG. 21 is a side cross-sectional view of the apparatus of FIG. 19.

FIG. 21 is a cross-sectional view of the apparatus 10 of FIG. 19. The mix head 20 does not have a divider 32, but does have a chamfer 34. The proximal end 24 is first disposed within the recess 60 so that the proximal end 24 is within the mix applicator 12, and the receiving portion 16 is located within the proximal end 24 and is within the mix head bore 26. A space exists between the distal end of the receiving portion 16 and the circular shaped section of the mix head 20. However, in other embodiments these portions may contact one another. The proximal end 24 may engage the wall of the mix applicator 12 from which the receiving portion 16 extends. Once the mix head 20 is in place within the mix applicator 12, the lock member 30 can be inserted into the holes 62, 64 of the mix applicator 12. The tines 48, 50 can extend through the holes 62, 64 and then can extend through the holes 54, 56 of the mix head 20. Upon further extension, the tines 48, 50 go through the slot openings the holes 62, 64 form in the receiving portion 16, and through the slot openings the holes 54, 56 form in the mix head 20, and then and out of the holes 54, 56 and through the bottom sections of the holes 62, 64 and out of the exterior surface 40 at the bottom of the mix applicator 12. The presence of tines 48, 50 prevents the mix head 20 from moving relative to the mix applicator 12 and keeps the mix head 20 retained onto the mix applicator 12. The lock member 30 can be removed in order to disengage the mix head 20 from the mix applicator 12. The mix head 20 could be inserted within the mix applicator 12 such that the entire square shaped proximal end 24 is within the recess 60, with the circular shaped section of the mix head 20 is outside of the recess 60 so that no portion of it is within the mix applicator 12.

The lock member 30 extends completely through the mix head 20, but need only extend through just a portion of the mix head 20 to effect attachment in other embodiments. The lock member 30 engages the mix applicator 12 via insertion into the holes 62, 64.

The mix applicator bore 14 does not have a helical member 58. The mix applicator bore 14 has a taper design and extends from the proximal end of the mix applicator 12 to the proximal end to the exit 68 such that the mix applicator bore 14 decreases in cross-sectional size uniformly upon extension in the distal to proximal direction. The exit 68 has the smallest cross-sectional size of the mix applicator bore 14 at any point of the mix applicator bore 14. Adhesive 18 is introduced into the mix applicator bore 14, and the tapering effects to build up pressure in the adhesive 18 as it is transferred and moved out of the exit 68 and into the mix head bore 26. From here, the adhesive 18 moves through the mix head bore 26 and channels down in the fan shaped section to the exit 66 from which it is dispensed into a ribbon of adhesive 18.

The apparatus 10 can be constructed such that a threaded connection is not present to be used to attach the mix head 20 to the mix applicator 12. The mix head 20, mix applicator 12, and lock member 30 may be made out of any type of material. These parts 12, 20, 30 could be made out of metal, nylon, or plastic in accordance with various exemplary embodiments. The previously described embodiments can be constructed so that the exit 66 has an area that is at least five times greater than the area of the exit 68. In one embodiment, the exit 66 has an area of 12.75 square millimeters and the exit 68 has an area of 2.545 square millimeters. In other embodiments, the exit 66 simply has a greater area than does the exit 68. However, it is to be understood that in yet other arrangements, the areas 66 and 68 are the same, and in yet further embodiments the exit 66 has a smaller are than exit 68.

While the present subject matter has been described in detail with respect to specific embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be apparent.

What is claimed is:

1. An apparatus, comprising:

a mix applicator having a mix applicator bore, wherein the mix applicator bore is configured to allow adhesive to flow through the mix applicator, wherein the mix applicator has a receiving portion;

a mix head that has a distal end and an oppositely disposed proximal end, wherein the mix head has a mix head bore that extends through the mix head, wherein the mix applicator is receivable within the mix head such that the receiving portion is located within the mix head, wherein the mix head bore of the mix head at a distal tip of the mix head is configured for dispensing of the adhesive in a ribbon shape; and a lock member that is configured for extending through at least a portion of the mix head and engaging the mix applicator when the receiving portion is located within the mix head in order to retain the mix head onto the mix applicator.

2. The apparatus as set forth in claim 1, wherein the lock member is movable relative to the mix head to disengage from the mix applicator in order to allow the mix head to be removed from the mix applicator.

3. The apparatus as set forth in claim 1, wherein the mix head has a divider located in a middle of the mix head bore configured for directing the adhesive from the middle of the mix head bore towards opposite ends of the dispensed ribbon shape.

4. The apparatus as set forth in claim 3, wherein the divider is spaced from the distal tip of the mix head such that the divider is not located at the distal tip.

5. The apparatus as set forth in claim 1, wherein the distal tip of the mix head is chamfered.

6. The apparatus as set forth in claim 1, wherein the receiving portion is defined on an exterior surface of the mix applicator, wherein the receiving portion has a projection that extends from the exterior surface of the mix applicator, wherein the lock member engages the projection when the receiving portion is located within the mix head in order to retain the mix head onto the mix applicator.

7. The apparatus as set forth in claim 6, wherein the mix applicator has a mix applicator central axis, and wherein the projection extends 360 degrees about the mix applicator central axis.

8. The apparatus as set forth in claim 1, wherein the lock member has a base and two tines that extend from the base, wherein the receiving portion of the mix applicator is located between the two tines when the lock member engages the mix applicator in order to retain the mix head onto the mix applicator.

9. The apparatus as set forth in claim 1, wherein the mix head has an exterior surface into which two holes are defined, wherein the lock member is located within the two holes when the lock member engages the mix applicator in order to retain the mix head onto the mix applicator.

10. The apparatus as set forth in claim 1, wherein the mix head bore has a square shaped cross-section at a proximal end of the mix head, wherein the mix head bore transitions to a circular shaped cross-section from the square shaped cross-section, and wherein the mix head bore transitions to a fan shaped cross-section from the circular shaped cross-section.

11. The apparatus as set forth in claim 1, wherein the mix applicator bore has a circular cross-sectional shape that is not the same diameter at all points along the length of the mix applicator bore, wherein a helical member is located within a portion of the mix applicator bore.

12. The apparatus as set forth in claim 1, wherein the mix applicator has a recess into which the mix head is disposed when the receiving portion is located within the mix head, wherein the mix applicator has mix applicator holes into which the lock member is disposed when the lock member extends through at least a portion of the mix head when the receiving portion is located within the mix head in order to retain the mix head onto the mix applicator.

13. The apparatus as set forth in claim 1, wherein an exit of the mix head bore from which the adhesive is configured for being dispensed has an area that is at least 5 times larger than an area of the exit of the mix applicator bore from which the adhesive is configured for being dispensed to the mix head bore.

14. The apparatus as set forth in claim 1, further comprising an adhesive pump that engages the mix applicator, wherein the adhesive is dispensed from the adhesive pump to the mix applicator bore.

* * * * *